United States Patent [19]

Korkut

[11] 4,015,552

[45] Apr. 5, 1977

[54] SEMI-SUBMERSIBLE DRILL BARGE

[76] Inventor: Mehmet D. Korkut, 3848 Veterans Blvd., Metairie, La. 70002

[22] Filed: Aug. 25, 1975

[21] Appl. No.: 607,856

[52] U.S. Cl. ..... 114/265

[51] Int. Cl.[2] ..... B63B 35/44

[58] Field of Search ..... 114/.5 D, 43.5 R, 43.5 AC; 61/46.5

[56] References Cited

UNITED STATES PATENTS

| | | | |
|---|---|---|---|
| 2,591,599 | 4/1952 | Parks | 61/46.5 |
| 2,942,425 | 6/1960 | De Long et al. | 61/46.5 |
| 2,987,892 | 6/1961 | Reeve | 61/46.5 |
| 3,011,467 | 12/1961 | Tourneall | 114/43.5 R |
| 3,610,193 | 10/1971 | Lacy | 114/.5 D |
| 3,685,305 | 8/1972 | Lloyd | 114/.5 D |
| 3,771,481 | 11/1973 | Goren et al. | 114/.5 D |

*Primary Examiner*—Trygve M. Blix
*Assistant Examiner*—Stuart M. Goldstein
*Attorney, Agent, or Firm*—James B. Lake, Jr.

[57] ABSTRACT

A double-ended, flat-bottomed hull, having a length to beam ratio of approximately 2 to 1+, with sides tapering from amidships to the pointed ends respectively. Two octagonal (in cross-section) end columns and two larger rectangular beam columns are equally spaced around the perimeter of the hull for supporting a work deck thereabove, for providing columnar storage rather than work deck storage and a lower center of gravity, and for eliminating external trussing. The configuration of the hull substantially increases its natural heaving period, and, coupled with an added-mass factor increased by chamfering the hull perimeter between columns and breakwaters mounted on an end and a beam, extend the range of wave height and period range of seas in which the barge can operate and avoid resonance and substantial beam wave effect.

5 Claims, 5 Drawing Figures

SEMI-SUBMERSIBLE DRILL BARGE

BACKGROUND OF THE INVENTION

1. Field of the Invention

The invention relates generally to drill barges and more particularly to semi-submersible drill barges for operating in an extended range of wave heights and periods.

2. Description of the Prior Art

Heretofore, semi-submersibles have included flat-ended barges or twin hull vessels both requiring external trussing between hulls and work decks, or conventional hulls, all being subject to considerable beam wave effect and short natural heaving periods.

SUMMARY OF THE INVENTION

The object of the invention is to provide a barge drill rig with no external trussing and substantially reduced beam wave effect.

Another object of the invention is to provide columnar storage with a resultant low center of gravity.

A further object of the invention is to provide a drill barge with a substantially increased natural heaving period coupled with an added-mass factor.

DETAILED DESCRIPTION

Figure 1:
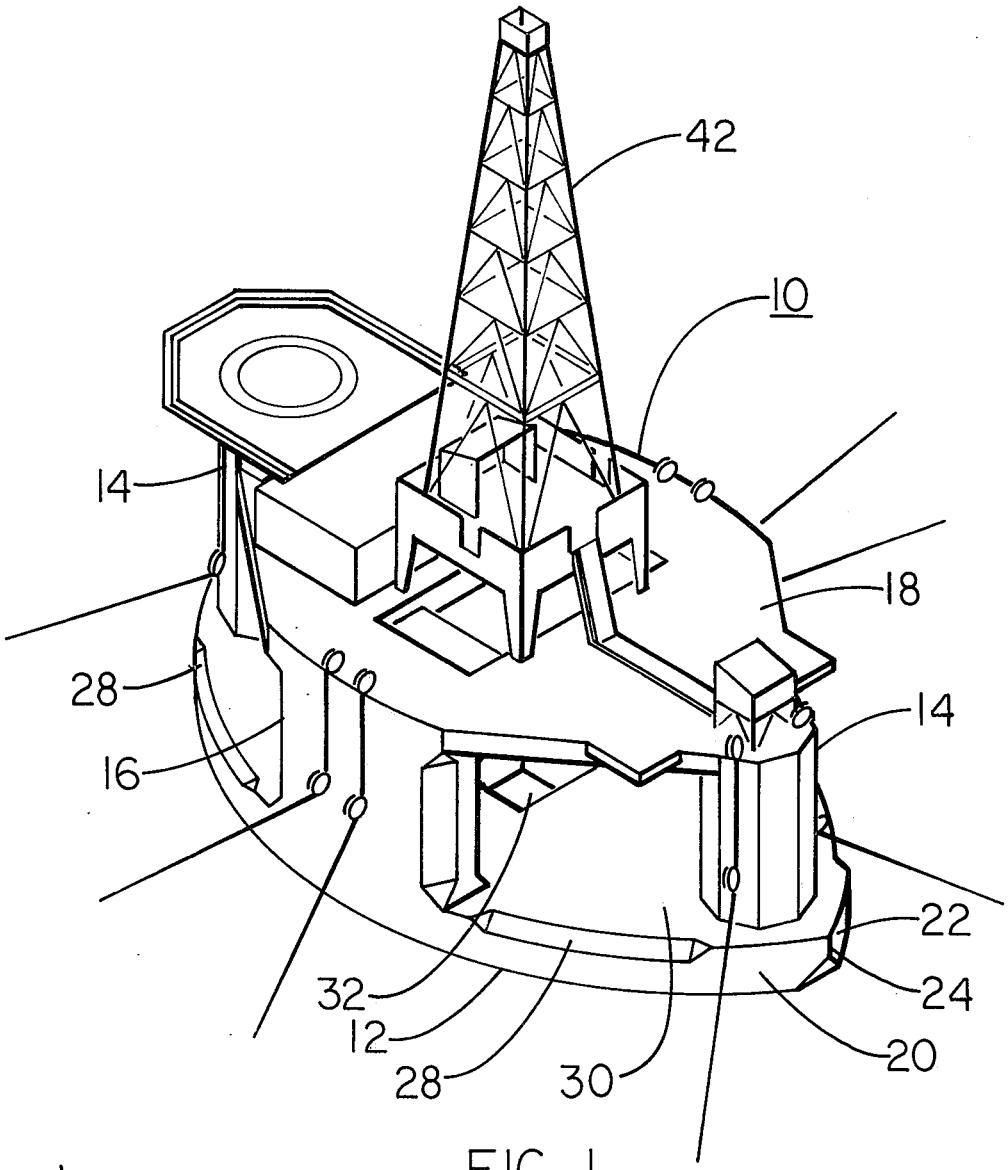
FIG. 1 is a three dimensional view from the upper left of the invention.

Referring to FIG. 1, the invention 10 comprises a double-ended, flat-bottomed hull 12 supporting on a pair of free-standing end columns 14 and a pair of free-standing beam columns 16 a work deck 18 without exterior trussing.

Figure 1A:
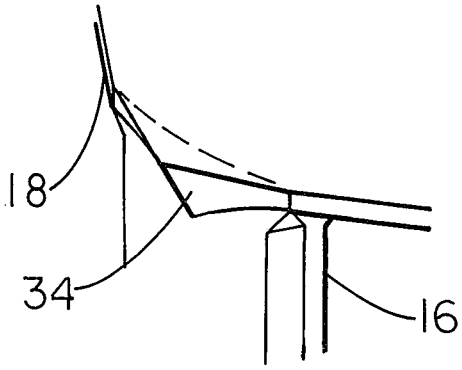
FIG. 1A is a partial three-dimensional view of optional upper-deck side wave deflectors.
Figure 1B:
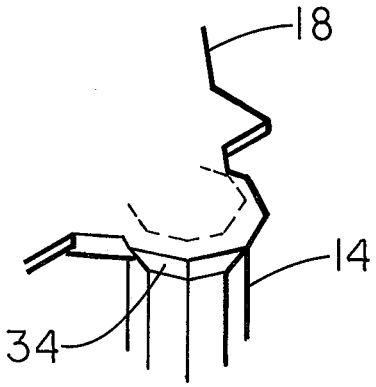
FIG. 1B is a partial three-dimensional view of optional upper-deck end wave deflectors.

Hull 12 is closed and has convex sides 20 and 22 that taper from amidships to oppositely disposed pointed ends 24 and 26. The convex or curved sides substantially reduce a beam effect of water and wind thereon. The ratio of length to width to depth of the hull 12 is of the order of 2 to 1+ to 0.06. Between pairs of columns 14 and 16 deck edges 28 are chamfered for directing water sweeping over and above a low freeboard along the deck 30 of hull 12 to maximize the added-mass effect of the water on the hull. This added-mass effect in addition to the convex sides, both stemming from the length to width to depth ratio, contribute to increasing the natural heaving period by approximately 1/3 more than that of conventional configuration semi-submersibles that is from about 18 to 23 seconds. As a result, hull 12, being so stabilized and less affected by wave direction, height and frequency, can continue drilling when other vessels of equal size have to stop. A center opening 32 is defined in hull 12 for the passage of a drill string therethrough. The center opening is closable at the bottom for fairing purposes when the invention is being towed. The remainder of the hull is subdivided into ballast and storage tanks 33. Optional wave deflectors 34 as illustrated in FIGS. 1A and 1B may be mounted on the tops of end columns 14 and beam columns 16 to help divide and direct high seas.

Figure 2:
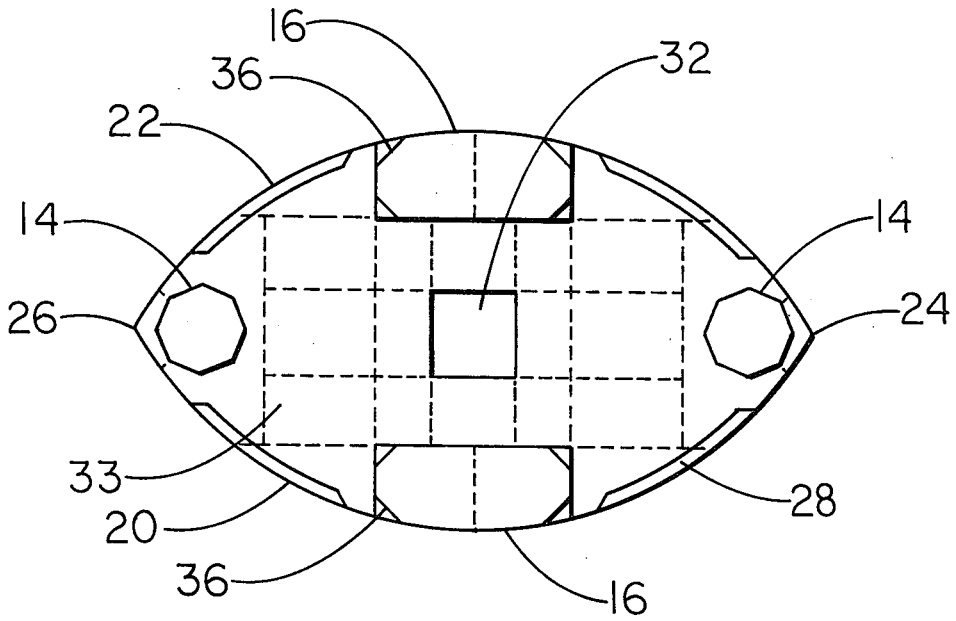
FIG. 2 is a plan view of the lower hull.
Figure 3:
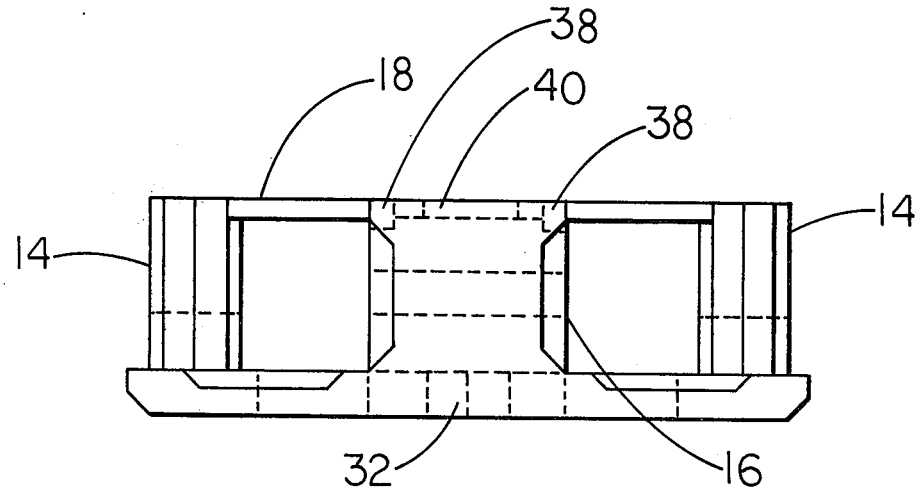
FIG. 3 is a side elevation of the hull of FIG. 1 omitting upper hull structure.

Referring to FIGS. 2 and 3, end columns 14 are preferably octagonal in cross-section for manufacturing them of flat plate and in identical halves, thus saving costly metal rolling presses and procedures and reducing manufacturing costs by building only halves rather than individual whole columns. Side columns 16 are larger and rectangular except for curved outboard sides that are conformed to and respectively continue convex sides 20 and 22 amidships. Vertical edges 36 of columns 16 are chamfered similarly to deck edges 28 for similar reasons. The respective beam columns are tied together at their upper extremities by means of box girders 38 which also transversly reinforces work deck 18 and provide safe throughways from one side to the other of work deck 18. Both pairs of columns 14 and 16 provide columnar storage and equipment space below the level of the work deck to generally lower the center of gravity of the invention.

Work deck or platform 18 is mounted on the top of columns 14 and 16 and box girders 38, and faired to conform with the columns. A drill aperture 40 is defined therein and in line with center opening 32 but larger to allow for the extended motion of its higher elevation. A drill rig 42 is mounted on work deck 18 over drill aperture 40 for supporting and operating a drill string passing through said aperture. An optional helicopter landing platform is shown as part of upper or working deck structure of FIG. 1.

What is claimed is:

1. An improved semi-submersible drill barge comprising:

a. a double-ended closed hull defining a center opening and having convex sides tapering fore and aft from a maximum beam amidships to sharp oppositely-disposed ends for reducing flat plate resistance ad increasing stability of hull;

b. two end columns mounted, respectively freestanding, on said respective hull ends to extend respectively upwardly therefrom, said columns being convexly structured for reducing resistance to wind and water;

c. two beam columns mounted, respectively freestanding, amidships and spaced transversely apart on said hull with the outboard sides of said columns being conformed to and in continuation of said convex sides of said hull for reducing resistance to wind and wave; and d. a work deck mounted on said end and beam columns and defining an aperture in vertical alignment with the center opening of said hull, said work deck mounting a drill rig over said aligned center opening and aperture.

2. An improved drill barge as described in claim 1 wherein said hull has a length to beam to depth ratio of 2 to 1.6 to 0.06 approximately for increasing its natural heave period and thus its stability in an extended range of wave direction, height and period.

3. An improved drill barge as described in claim 1 wherein said end columns are octagonal in cross-section for forming out of flat plate in indentical halves.

4. An improved drill barge as described in claim 1 wherein said beam columns are approximately rectangular in cross-section with chamfered vertical edges to reduce resistance to wind and water.

5. An improved drill barge as described in claim 1 wherein said beam columns are connected at their upper extremities with box girders for strengthening the structure and providing a covered passageway from one side to the other of said work deck.

* * * * *